United States Patent [19]

Clough et al.

[11] Patent Number: 4,844,688

[45] Date of Patent: Jul. 4, 1989

[54] GAS TURBINE ENGINE CONTROL SYSTEM

[75] Inventors: Richard S. Clough; Peter F. Neal, both of Derby, England

[73] Assignee: Rolls-Royce plc, London, England

[21] Appl. No.: 87,804

[22] Filed: Aug. 21, 1987

[30] Foreign Application Priority Data

Oct. 8, 1986 [GB] United Kingdom ..... 8624164

[51] Int. Cl.[4] ..... F04D 31/00

[52] U.S. Cl. ..... 415/116; 415/173.2; 415/127; 415/113

[58] Field of Search ..... 415/116, 171, 174, 113, 415/127; 60/39.29, 39.75

[56] References Cited

U.S. PATENT DOCUMENTS

| | | | |
|---|---|---|---|
| 4,019,320 | 4/1977 | Ridinger, Jr. et al. | 415/116 |
| 4,023,919 | 5/1977 | Patterson | 415/174 |
| 4,363,599 | 12/1982 | Cline et al. | 415/171 |
| 4,472,108 | 9/1984 | Pask | 415/174 |
| 4,683,716 | 8/1987 | Wright et al. | 415/171 |

FOREIGN PATENT DOCUMENTS

| | | |
|---|---|---|
| 1484288 | 12/1974 | United Kingdom . |
| 1484936 | 12/1974 | United Kingdom . |
| 1605255 | 12/1975 | United Kingdom . |
| 2087979 | 6/1982 | United Kingdom . |

*Primary Examiner*—Robert E. Garrett
*Assistant Examiner*—Therese M. Newholm
*Attorney, Agent, or Firm*—Cushman, Darby & Cushman

[57] ABSTRACT

The high pressure turbine of a gas turbine engine is provided with an annular array of aerofoil rotor blades which are surrounded by a shroud. The shroud is mounted on a tubular diaphragm which is deflected by pressure modulation to vary the effective diameter of said shroud means. An L-shaped cross-section flange provided on the turbine casing cooperates with a plurality of L-shaped cross-section hooks on the diaphragm to limit radially inward movement of the shroud and thereby prevent contact between the aerofoil blade tips and the shroud means.

10 Claims, 2 Drawing Sheets

GAS TURBINE ENGINE CONTROL SYSTEM

This invention relates to a system for controlling the clearance between rotatable and static portions of a gas turbine engine and has particular reference to rotatable and static portions of the turbine of such an engine.

The turbine of a gas turbine propulsion engine conventionally comprises at least one annular array of radially extending aerofoil blades which are mounted on the circumference of a disc rotatable about the longitudinal axis of the turbine. The tips of the aerofoil blades are surrounded by an annular shroud which is coaxial with the turbine axis. The aerofoil blade tips are positioned as closely as possible to the radially inner surface of the shroud in order to minimise the leakage of turbine gases between the shroud and the blade tips. However during the conventional operating cycle of a gas turbine engine, the aerofoil blades, the disc on which they are mounted and the shroud, are subject to large variations in temperature. In addition, the aerofoil blades and their disc are subject to centrifugal loads which result in some degree of radial growth. All of these factors have an effect on the clearance between the blade tips and the shroud so that precautions have to be taken to ensure that damaging contact between the shroud and blade tips is avoided.

One way in which contact can be avoided is to provide a radial clearance between the blade tips and the shroud which is sufficiently large as to ensure that contact is avoided even in the most extreme of circumstances. The drawback with such an approach however is that under normal operating conditions, the clearance is usually so large as to provide an unacceptable level of gas leakage.

A further, more sophisticated, method of minimising turbine gas leakage is to provide a suitable device on the shroud, which may be thermal or mechanical in operation, to vary the effective diameter of the shroud in such a manner that the clearance between the blade tips and the shroud remains substantially constant at an optimum value. One way in which this can be achieved is to provide a shroud which is made up of a number of circumferentially adjacent segments, each of which is supported at its radially outer extent on the radially inner surface of a tubular diaphragm. Modulation of the gas pressure on the radially outer surface of the diaphragm results in the diaphragm deflecting radially inwardly or outwardly depending upon the gas pressure on the radially inner diaphragm surface, thereby causing the shroud segments to be radially translated towards or away from the blade tips. By suitable modulation of the gas pressure on the radially outer surface of the diaphragm, the radial clearance between the shroud segments and the blade tips may be maintained at a substantially constant level.

Although under cruise conditions, such pneumatically activated tip clearance control systems are capable of providing an acceptable degree of control over shroud/blade tip clearances, they can be troublesome if the gas turbine engine is subjected to a sudden rapid decrease in its rotational speed. If such a sudden decrease occurs, the gas pressure on the radially inner face of the diaphragm also rapidly decreases with the result that the shroud segments are translated radially inwards towards the blade tips. Since the blades and the disc on which they are mounted will still be at a comparatively high temperature and therefore thermally expanded, there is a danger that under these conditions contact will occur between the blade tips and the shroud segments.

It is an object of the present invention to provide a system for controlling the radial clearance between the blade tips and shroud in which the likelihood of contact occuring between them is substantially eliminated.

According to the present invention, a gas turbine engine comprises at least one annular array of aerofoil rotor blades, the radially outer extents of which are surrounded in radially spaced apart relationship by shroud means, pneumatic actuation means associated with said shroud means to radially translate said shroud means to vary the radial clearance between said shroud means and said aerofoil blades, and an annular support member located radially outwardly of said aerofoil blades and associated with said shroud means in such a manner that any translation of said shroud means in a radially inward direction which is greater than a predetermined amount is limited by the interengagement of said shroud means and said annular support member so that engagement between said shroud means and said aerofoil blades is substantially avoided.

The invention will now be described by way of example, with reference to the accompanying drawings in which.

Figure 1:
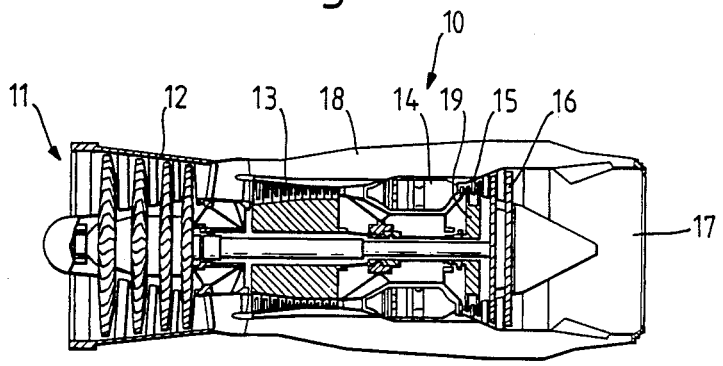
FIG. 1 is a sectioned side view of a gas turbine propulsion engine in accordance with the present invention

With reference to FIG. 1, a by-pass gas turbine propulsion engine generally indicated at 10 comprises, in axial flow series, an air intake 11, a low pressure compressor 12, a high pressure compressor 13, combustion equipment 14, a high pressure turbine 15, a low pressure turbine 16 and a propulsion nozzle 17. The gas turbine engine 10 functions in the conventional manner whereby air drawn in through the intake 11 is compressed by the low pressure compressor 12 before being divided into two portions. One portion flows into a annular by-pass duct 18 while the remainder passes into the high pressure compressor 13 where it is further compressed. The compressed air exhausted from the high pressure compressor 13 is then mixed with fuel and the mixture combusted in the combustion equipment 14. The resultant combustion products then expand through the high pressure turbine 15, which is drivingly connected to the high pressure compressor 13, and the low pressure turbine 16 which is drivingly connected to the low pressure compressor 12 before mixing with the by-pass air flow and exhausting to atmosphere through the propulsion nozzle 17.

Figure 2:
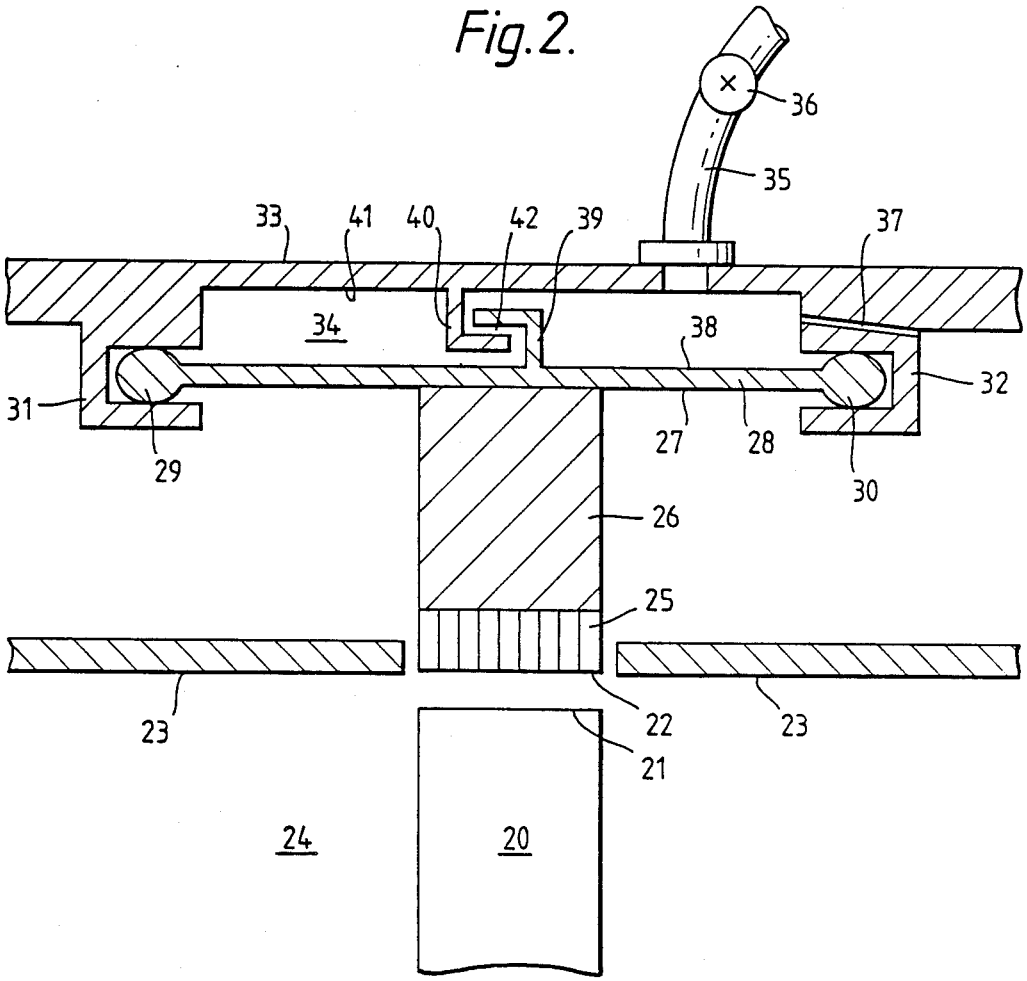
FIG. 2 is an enlarged view of the turbine of the gas turbine engine shown in FIG. 1

The first stage of the high pressure turbine comprises a disc 19 on the circumference of which are mounted an annular array of radially extending aerofoil blades 20, the radially outer extent of one of which can be seen more clearly in FIG. 2. The radially outer tips 21 of the aerofoil blades 20 are surrounded by a shroud 22 in radially spaced apart relationship. The shroud 22 is coaxial with the longitudinal axis of the engine 10 and constitutes an axial portion of the radially outer wall 23 of the gas passage 24 through the high pressure turbine 15. The shroud 22 is made up of a plurality of segments 25 and each shroud segment 25 is carried by a radially extending support member 26 which is in turn attached to the radially inner surface 27 of a tubular diaphragm 28. The diaphragm 28 is also coaxial with the longitudinal axis of the engine 10 and is provided with enlarged upstream and downstream edges 29 and 30 which respectively locate in grooved flanges 31 and 32 provided on the radially inner surface of the casing 33 of the high pressure turbine 19. The diaphragm 28 and the casing 33 thus cooperate to define an annular chamber 34. The chamber 34 is supplied with compressed air derived from the high pressure compressor 13 of the engine 10 via a supply conduct 35 having a valve 36. A series of small diameter ducts 37 permit the exhaustion of compressed air from the chamber 34. Adjustment of the valve 36 causes changes in the air pressure within the chamber 34 and this in turn results in the radial deflection of the diaphragm 28 and in consequence the radial translation of the support members 26 and the shroud segments 25 which they support. Thus modulation of the air pressure within the chamber 34 directly results in changes in the radial clearance between the shroud 22 and the blade tips 21.

Any convenient control system may be used to control the air pressure within the chamber 34. For instance, a measuring device may be incorporated into the high pressure turbine 19 to monitor the shroud 22/blade tip 21 clearance and the signal from such a device used as an input signal to a control system adapted to modulate the air pressure within the chamber 34 so that the clearance remains at a constant pre-determined value. However we prefer to use a control system of the type described in our corresponding UK patent application number 8618314 in which the optimum shroud 22/blade tip 21 clearance in a given situation is computed and the pressure within the chamber 34 modulated so that the clearance is maintained at the computed value.

As the gas turbine engine 10 progresses through a typical operating cycle, the aerofoil blades 20 and the disc 19 on which they are mounted heat up and thermally expand. Additionally the high speed of rotation of the disc 19 results in a certain degree of radial centrifugal growth of the disc 19 and blades 20. These effects all contribute to a reduction in the radial clearance between the blade tips 21 and the shroud 25 so that an appropriate change in the air pressure within the chamber 34 is necessary to bring about an increase in the blade tip 21/ shroud 22 clearance. However if the gas turbine engine 10 is suddenly decelerated so that the rotational speed of the disc 19/blade 20 array suddenly drops, there is an immediate danger of the diaphragm 28 deflecting radially inwards due to the rapid reduction in gas pressure within the turbine gas passage 24. If this happens, it is quite likely that contact will occur between the shroud 22 and the blade tips 21 since the blades 20 and their disc 19 will still be at a comparatively high temperature and therefore thermally expanded.

In order to ensure that under conditions of sudden deceleration contact does not take place between the shroud 22 and the blade tips 21, the radially outer face 38 of the diaphragm 27 is provided with a plurality of L-shaped cross-section hooks 39 which correspond in cross-sectional shape with and are positioned so as to cooperate with an L-shaped cross-section flange 40 provided on the radially inner face 41 of the casing 33. Under normal operating conditions, the hooks 39 and flange 40 are radially spaced apart from each other by a gap 42 as shown in the drawing so as to permit a certain degree of unimpeded deflection of the diaphragm 28 in both radially inward and outward directions. However in the event of a sudden engine deceleration with the consequent deflection of the diaphragm 28 in a radially inward direction, the hooks 39 and flange 40 are so configured as to engage each other before contact occurs between the shroud 22 and the blade tips 21. This has the effect of limiting the radially inward movement of the shroud 22 to the rate at which the casing 33 thermally contracts as it cools down following deceleration. The casing 33 is of comparatively high mass so that its rate of cooling is similar to that of the combined assembly of the rotor blade 20 and the disc 19 in which they are mounted. This being so, the gap between the blade tips 21 and the shroud 22 remains at an acceptable level without the danger of contact occuring between them.

In the event of a sudden acceleration of the gas turbine engine 10, there will be a rapid increase in the temperature, and hence thermal growth, of the blades 20 and the disc 19. However since such a rapid acceleration will also result in rapid increase in the gas pressure within the gas passage 24, the diaphragm 28 will deflect in a radially outward direction, unimpeded by the hooks 39 and flange 40, so as to avoid contact between the blade tips 21 and the shroud 22.

It may be desirable in certain circumstances to exert a greater degree of control over the clearance between the blade tips 21 and the shroud 22, particularly when the gas turbine engine 10 is decelerated. This control may be achieved using a modified version of the present invention which can be seen if reference is now made to the embodiment illustrated in FIG. 3. Certain of the features of the embodiment shown in FIG. 3 are common with the previous embodiment described with reference to FIG. 2 and those features have been given common reference numbers.

Figure 3:
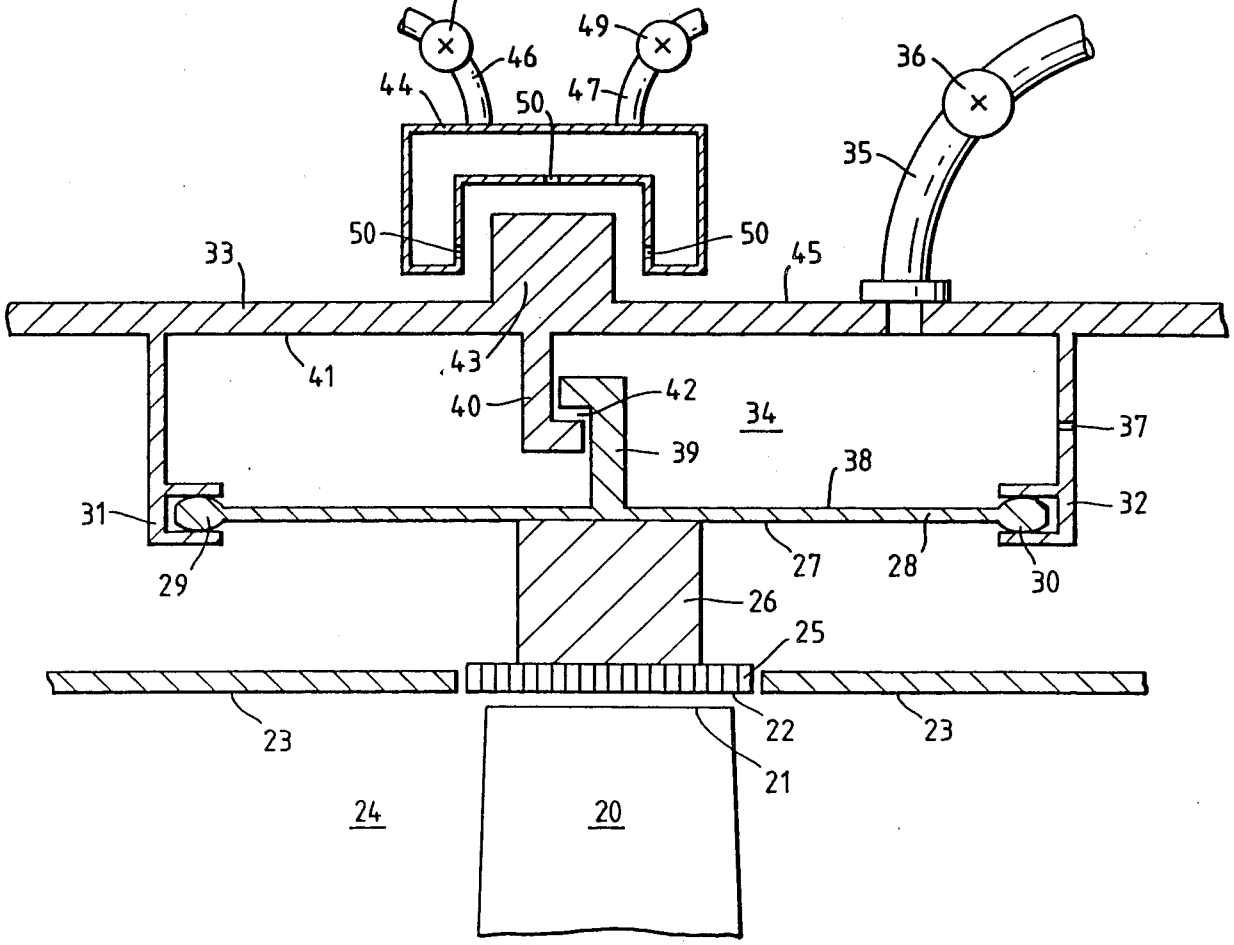
FIG. 3 is an enlarged view of an alternative form of the turbine portion shown in FIG. 2.

With reference to FIG. 3, the major feature which is not common with the embodiment of FIG. 2 is a support ring 43 which is integral with the casing 33 and which is surrounded by a U-shaped cross-section air manifold 44. The ring 43 is located immediately radially outwardly of the flange 40 on the external surface 45 of the casing 33 so that any thermal expansion or contraction of the ring 43 determines the diameter of the flange 40. This being so, the ring 43 influences the point at which the hooks 39 engage the flange 40.

The air manifold 44 is fed with relatively cool and hot air via pipes 46 and 47 respectively derived from appropriate sections of the low and high pressure compressors 12 and 13. Valves 48 and 49 in the pipes 46 and 47 respectively control the flow of cool and hot air into the manifold 44 so that the air temperature within the manifold 44 may be varied over a large temperature range. A large number of small holes 50 are provided in the manifold 44 to direct the air from the manifold 44 on to the ring 43 so as to regulate the temperature of the ring 43 and hence, in turn, its diameter as a result of thermal expansion and contraction.

In operation, during deceleration conditions, the temperature of the ring 43 is so adjusted that the amount of radial movement which the shroud 22 is permitted to make by the interaction of the hooks 39 and the flange 40 is directly related to the degree of thermal growth of the disc 19 and its blades 20. Thus the shroud 22 is initially permitted to travel radially inwards by an amount sufficient to permit a small clearance between the shroud 22 and the blade tips 21 without contact occuring between them. As the disc 19 and blades 20 continue to cool down and hence thermally contract, the temperature of the air directed on to the ring 43 is adjusted to ensure that the rate of thermal contraction of the ring 43 corresponds with that of the disc 19/blade 20 assembly. This in turn ensures that the clearance between the shroud 22 and the blade tips 21 remains at a substantially constant optimum value.

The flow of cool and hot air to the manifold 44 and indeed the air pressure within the chamber 34 are preferably controlled by a device such as a computer associated with the gas turbine engine 10 which is capable of predicting the radial extent of the tips 21 of the blades 20 and modulating the cool and hot air flows to ensure that the shroud 22 is only permitted to travel radially inwardly to the extent necessary to ensure an optimum blade tip 21/shroud 22 clearance.

Although the present invention has been described with reference to a blade tip clearance control system which relies on the pneumatic operation of an annular diaphragm 28, it will be appreciated that it is also applicable to systems in which other pneumatic means, such as pistons, are employed.

We claim:

1. A gas turbine engine comprising a casing enclosing at least one annular array of aerofoil rotor blades, the radially outer extends of which are surrounded in radially spaced apart relationship by shroud means, pneumatic actuation means associated with said shroud means to radially translate said shroud means to vary the radial clearance between said shroud means and said aerofoil blades, and an annular support member located radially outwardly of said aerofoil blades and interconnected with said shroud means in such manner that relative radial movement between said shroud means and said support member to a selected degree is provided and any translation of said shroud means in a radially inward direction which is greater than a predetermined amount is limited by the interengagement of said shroud means and said annular support member so that engagement between said shroud means and said aerofoil blades is substantially avoided, said annular support member and said shroud means being associated with corresponding engagement means to provide said interengagement, and further comprising means for controlling the amount of relative radial movement permitted between said shroud means and said support member.

2. A gas turbine engine as claimed in claim 1 wherein said pneumatic means comprises a tubular diaphragm.

3. A gas turbine engine as claimed in claim 2 wherein said diaphragm is interposed between said shroud means and said casing, said diaphragm and casing cooperating to define an annular chamber, means being provided to modulate the gas pressure within said annular chamber so as to bring about the deflection of said diaphragm and thereby faciliate the radial translation of said shroud means.

4. A gas turbine engine as claimed in claim 3 wherein said shroud means is mounted on the radially inner surface of said diaphragm.

5. A gas turbine engine comprising a casing enclosing at least one annular array of aerofoil rotor blades, the radially outer extents of which are surrounded in radially spaced apart relationship by shroud means, pneumatic actuation means associated with said shroud means to radially translate said shroud means to vary the radial clearance between said shroud means and said aerofoil blades, and an annular support member located radially outwardly of said aerofoil blades and interconnected with said shroud means in such manner that relative radial movement between said shroud means and said support member to a selected degree is provided and any translation of said shroud means in a radially inward direction which is greater than a predetermined amount is limited by the interengagement of said shroud means and said annular support member so that engagement between said shroud means and said aerofoil blades is substantially avoided, said annular support member and said shroud means being associated with corresponding engagement means to provide said interengagement, said pneumatic actuation means comprising a tubular diaphragm, said diaphragm being interposed between said shroud means and said casing, said diaphragm and casing cooperating to define an annular chamber, means being provided to modulate the gas pressure within said annular chamber so as to bring about the deflection of said diaphragm and thereby facilitate the radial translation of said shroud means, said shroud means being mounted on the radially inner surface of said diaphragm, said engagement means associated with said shroud means being located on the radially outer surface of said diaphragm.

6. A gas turbine engine as claimed in claim 5 wherein said annular support member is constituted by a portion of said casing of said gas turbine engine, said engagement means associated with said shroud means being located on the radially inner surface of said casing

7. A gas turbine engine as claimed in claim 6 wherein said annular support member is of greater thickness than the remainder of said casing.

8. A gas turbine engine as claimed in claim 7 wherein means are provided to vary the temperature of said annular support member and hence its diameter.

9. A gas turbine engine as claimed in claim 8 wherein said means provided to vary the temperature of said annular support member comprises an annular manifold which coaxially surrounds said annular support member and which is adapted to direct temperature regulating fluid thereon.

10. A gas turbine engine as claimed in claim 9 wherein said temperature regulating fluid is air.

* * * * *